US005408859A

United States Patent [19]

Bakermans

[11] Patent Number: 5,408,859

[45] Date of Patent: Apr. 25, 1995

[54] METHOD OF DISTRIBUTING TORQUE BETWEEN MULTIPLE PRESS MODULES

[75] Inventor: Johannes C. W. Bakermans, Harrisburg, Pa.

[73] Assignee: The Whitaker Corporation, Wilmington, Del.

[21] Appl. No.: 71,139

[22] Filed: Jun. 2, 1993

[51] Int. Cl.[6] ..... B21D 7/06

[52] U.S. Cl. ..... 72/407; 72/405; 72/441; 72/446; 72/452; 100/257

[58] Field of Search ..... 72/407, 441, 450, 446, 72/452, 403, 405; 100/257

[56] References Cited

U.S. PATENT DOCUMENTS

| | | | |
|---|---|---|---|
| 3,695,088 | 10/1972 | Alvi et al. | 72/405 |
| 3,837,210 | 9/1974 | Kralowetz | 72/403 |
| 3,888,104 | 6/1975 | Ribback | 72/452 |
| 4,497,196 | 2/1985 | Bakermans et al. | 72/405 |
| 4,676,090 | 6/1987 | Nishimura et al. | 72/446 |
| 4,819,476 | 4/1989 | Bakermans et al. | 72/456 |
| 4,934,173 | 6/1990 | Bakermans et al. | 72/452 |
| 5,007,282 | 4/1991 | Bakermans | 72/481 |
| 5,199,290 | 4/1993 | Kashiwagi et al. | 72/446 |
| 5,299,443 | 4/1994 | Nakamura | 72/446 |
| 5,321,969 | 6/1994 | Bakermans | 72/407 |

*Primary Examiner*—David Jones

[57] ABSTRACT

A method of distributing rotational power from a common drive shaft assembly to two or more stamping and forming modules is disclosed. The method includes shortening the length of stroke of the ram assemblies of selected modules thereby permitting them to achieve higher working forces at their stamping and forming tooling than other modules whose ram assemblies have a longer length of stroke.

8 Claims, 5 Drawing Sheets

METHOD OF DISTRIBUTING TORQUE BETWEEN MULTIPLE PRESS MODULES

The Present invention relates to stamping and forming machines having one or more operational modules wherein the operations being performed in each module have different force and stroke length requirements and more particularly to the distribution and allocation of available power to such modules.

BACKGROUND OF THE INVENTION

U.S. Pat. Nos. 4,497,196 and 4,819,476 disclose a stamping and forming machine having first and second ram assemblies which are reciprocable toward and away from each other along horizontal paths of reciprocation. Strip material is fed along a strip feed path which extends between the ram assemblies. The ram assemblies have tooling on their ends for performing stamping and forming operations on the strip. The ram assemblies are reciprocated by oscillating levers to which the are coupled. The levers, in turn, are coupled to a central power shaft by eccentric assemblies. An example of such tooling is disclosed in U.S. Pat. No. 5,007,282 which sets forth a typical punch assembly for use in a stamping and forming machine, and which is incorporated herein by reference. The above referenced stamping and forming machines as well as most stamping presses have fixed rather than adjustable strokes. While such fixed stroke machines are useful for many stamping and forming operations, it would be desirable to provide a means for adjusting the stroke of the ram assemblies where two or more modules, each having its own ram assembly, are coupled together by a common drive shaft, as described in U.S. Pat. No. 4,497,196. Such an adjusting means is disclosed in co-pending U.S. patent application Ser. No. 07/968,012, filed Oct. 29, 1992, now U.S. Pat. No. 5,321,969 and assigned to the present assignee, and which is incorporated herein by reference. The present invention includes the utilization of such an adjusting means in stamping and forming machines having multiple modules to achieve superior performance and additional versatility.

SUMMARY OF THE INVENTION

The present invention is a method of distributing power in a machine having at least two stamping and forming modules with their drive shafts rotationally coupled together. Each module includes, a drive shaft, first and second ram assemblies which are reciprocable toward and away from each other between forward and retracted positions, and first and second actuator levers for reciprocating the ram assemblies. Each lever is coupled to its associated ram assembly and has a fixed pivot. The first and second levers are coupled to the drive shaft by first and second adjustable couplings which are adjustable for altering the length of stroke of the first and second ram assemblies. The method includes distributing power from the coupled drive shafts to the ram assemblies of the two stamping and forming modules, comprising the following steps:

(a) determining the minimum length of stroke required to perform the stamping and forming operation in a selected module, (b) adjusting the adjustable couplings associated with the selected module to effect a stroke length of its ram assemblies at least as long as the determined minimum length, and (c) adjusting the adjustable couplings associated with another module to effect a stroke length of its ram assemblies that is different from that of the selected module.

DESCRIPTION OF THE PREFERRED EMBODIMENT

Figure 1:
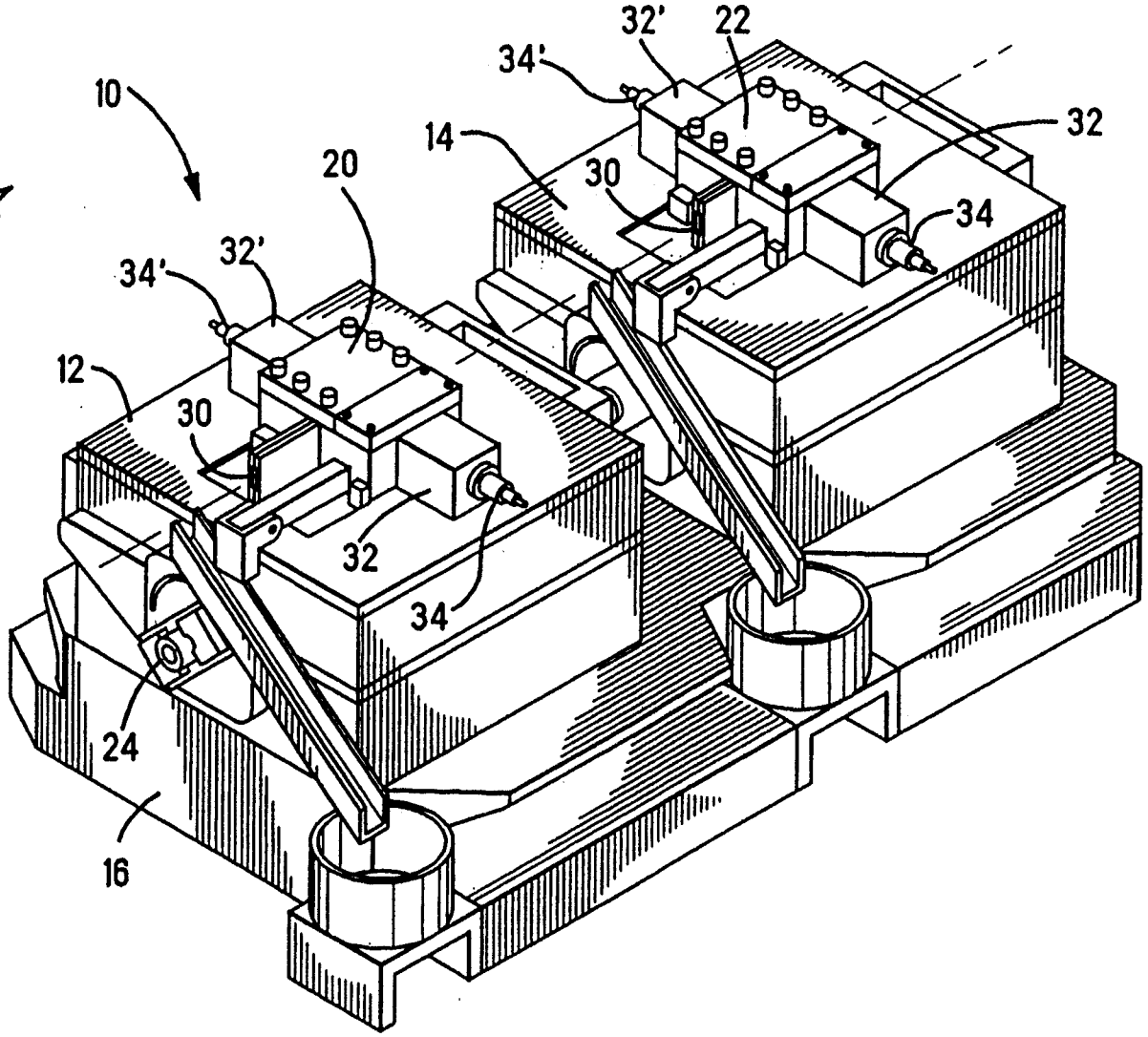
FIG. 1 is an isometric view of a two module stamping and forming machine incorporating the teachings of the present invention.
Figure 2:
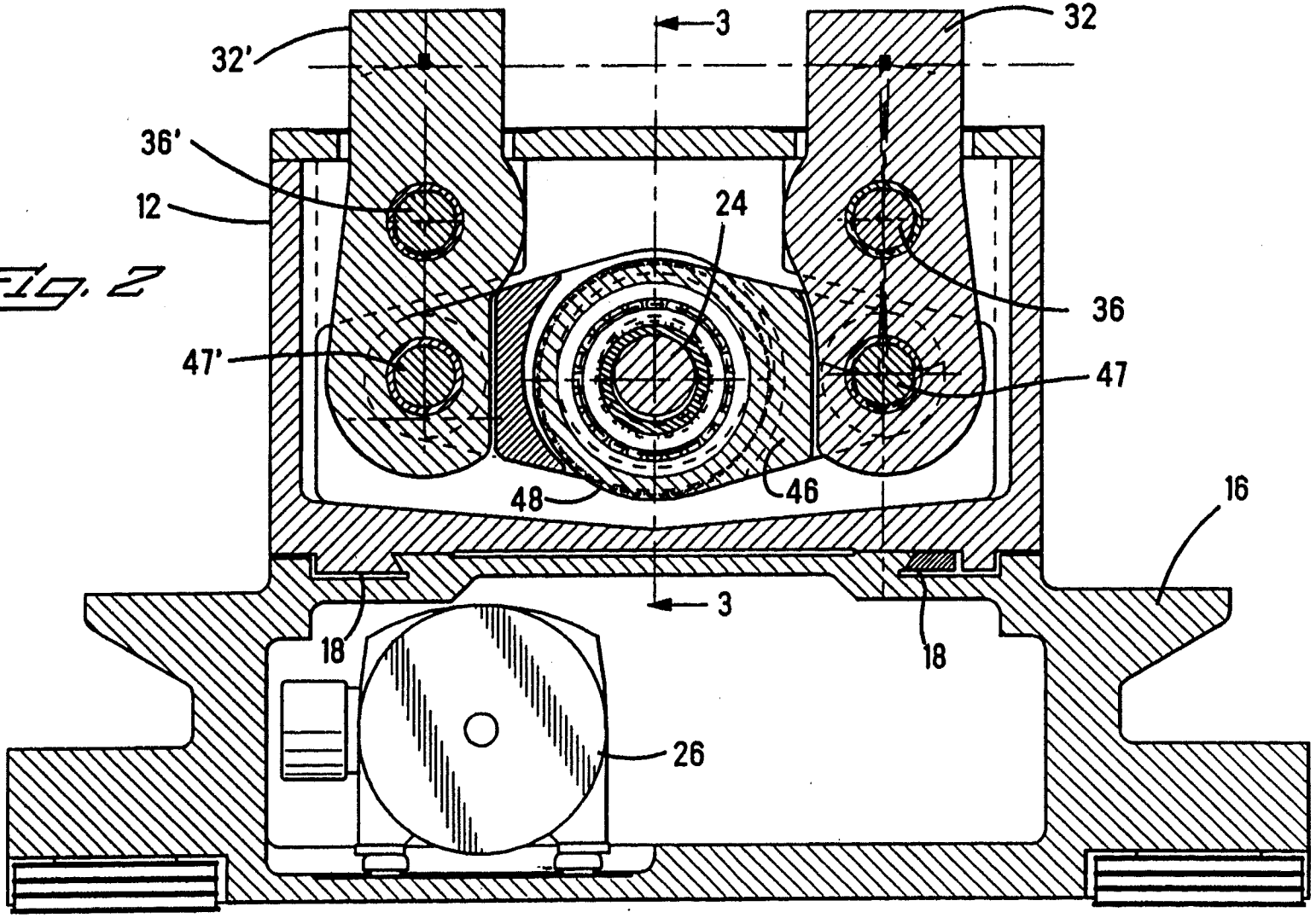
FIG. 2 is a partial cross-sectional view taken vertically through one of the modules shown in FIG. 1.
Figure 3:
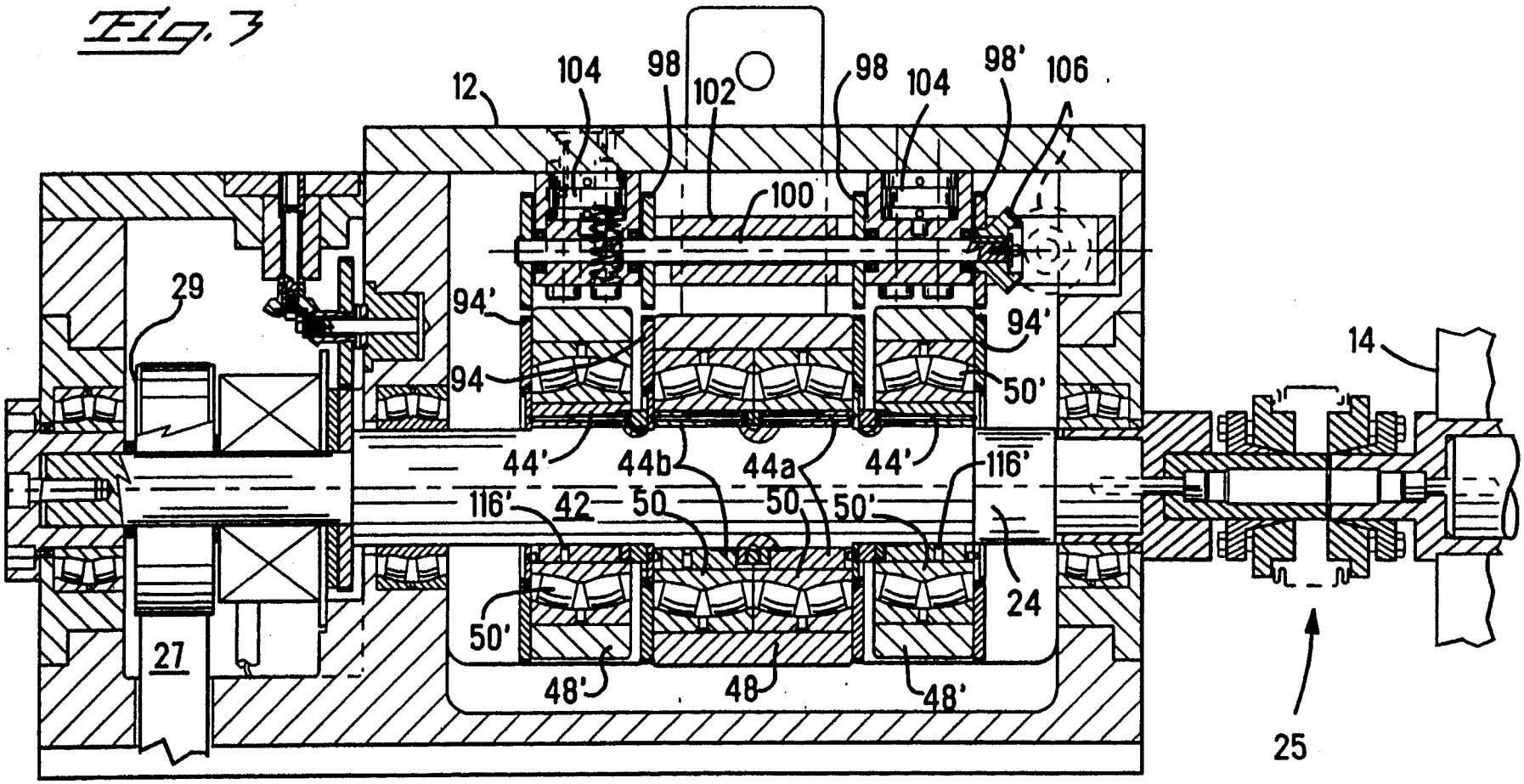
FIG. 3 is a cross-sectional view taken along the lines 3—3 in FIG. 2.
Figure 4:
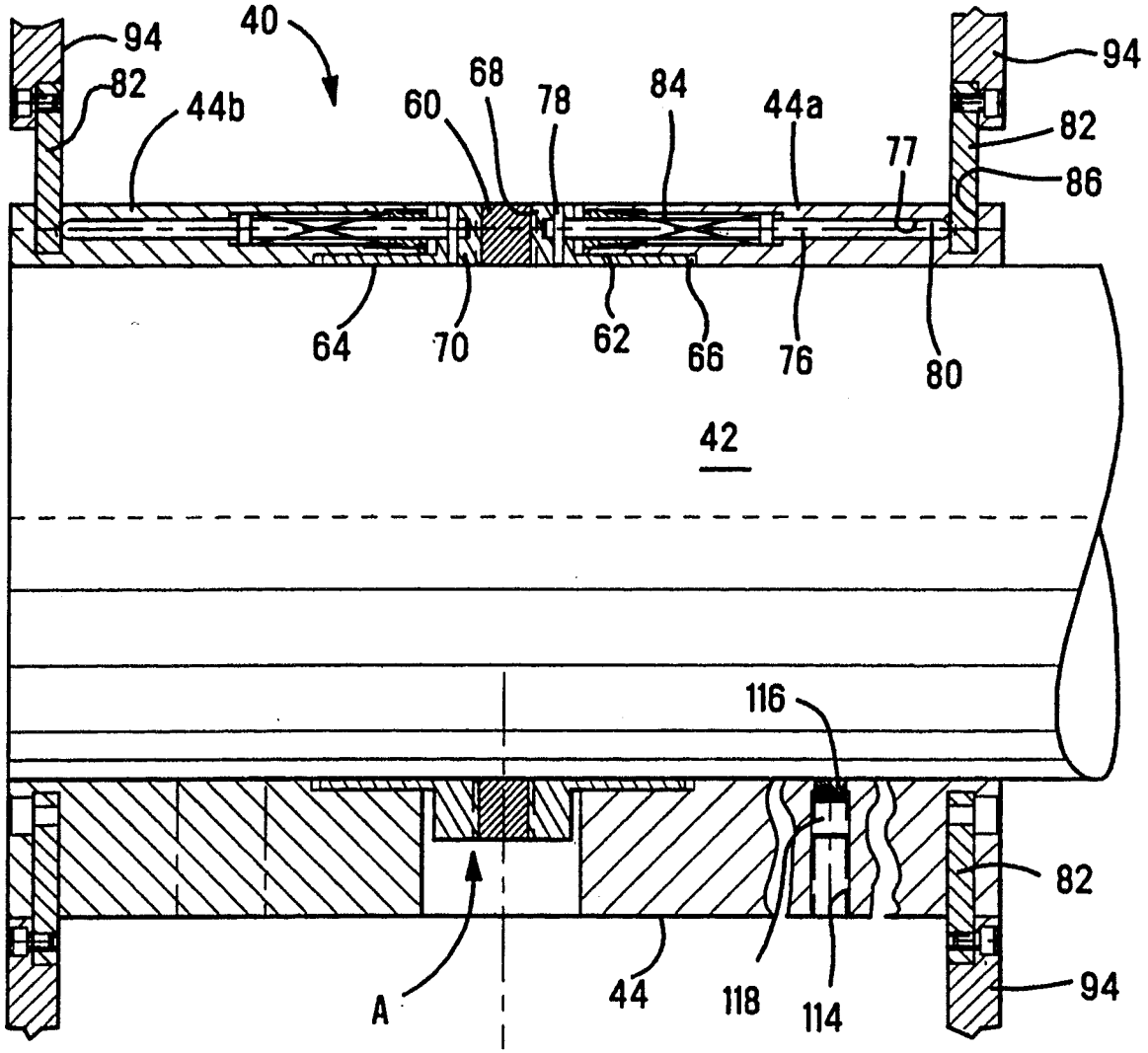
FIG. 4 is an enlarged view of a portion of the adjustment mechanism shown in FIG. 3.
Figure 6:
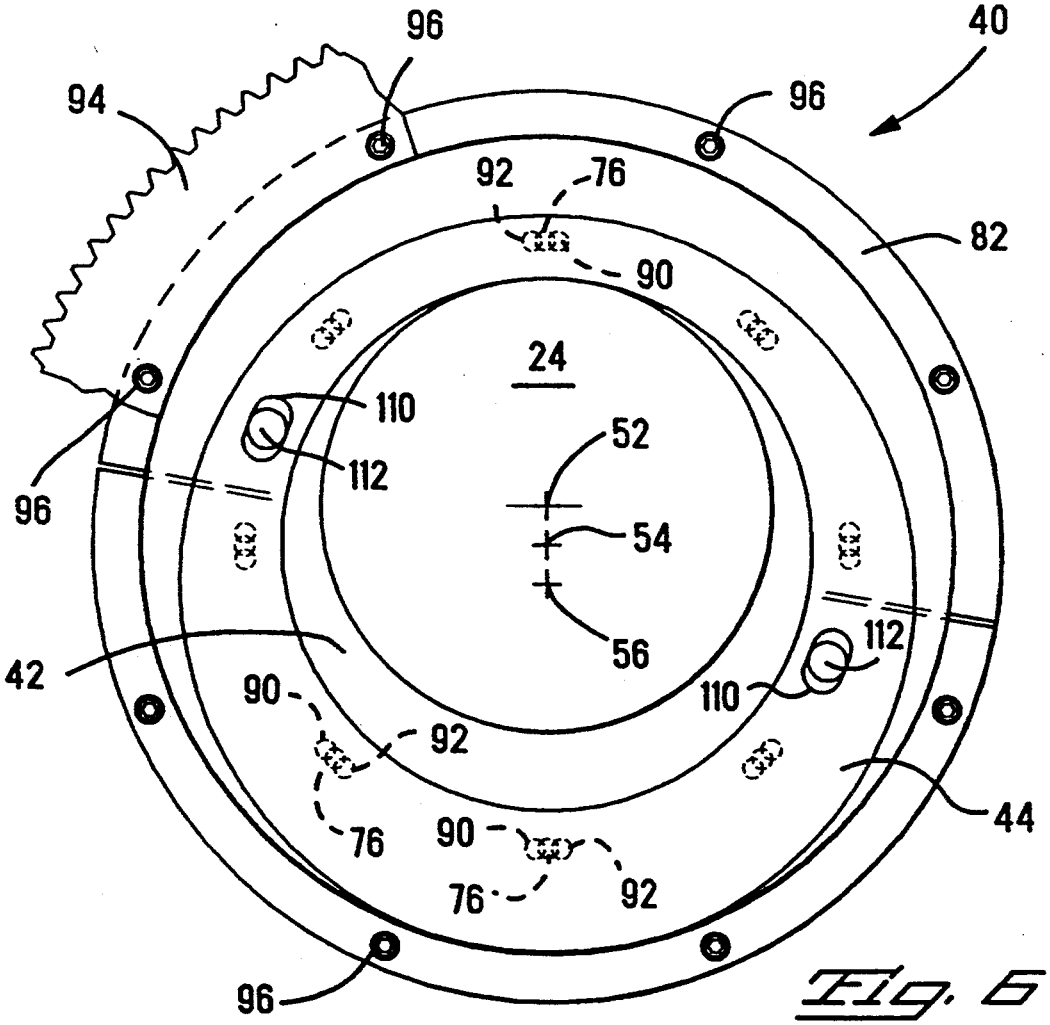
FIG. 6 is a view along the axis of the drive shaft showing the adjustment mechanism.

There is shown in FIG. 1 a stamping and forming machine 10 having a first stamping and forming module 12 and a second stamping and forming module 14. The first and second modules, 12 and 14, are mounted to a machine base 16 and arranged in ways 18, as best seen in FIG. 2, so that their relative spacing can be adjusted when the machine is set up for a particular job. This assures that tooling in the first module will be in proper alignment with respect to the tooling in the second module so that a strip having operations performed on it in the first module will be in proper alignment in the second module for further operations there. The modules 12 and 14 have first and second tooling assemblies 20 and 22, respectively, mounted to their top mounting plates, as shown in FIG. 1. These tooling assemblies are omitted from FIG. 2 for clarity. Each module has a drive shaft 24 and an electric motor 26 for rotating the drive shaft during operation of the machine. The motor is coupled to the drive shaft 24 by means of the belt 27 and pulley 29 in the usual manner, as shown in FIG. 3. The two drive shafts 24 are rotationally coupled together by a coupling assembly 25. Each tooling assembly 20 and 22 includes a pair of opposing ram assemblies which contain tooling on their ends which mate to perform the stamping and forming operation on strip stock that is fed through aligned slots 30. The opposing ram assemblies of each module are arranged to reciprocate toward and away from each other and are caused to reciprocate by means of first and second levers 32 and 32' which are coupled to their respective rams as shown at 34 and 34'. Each lever 32, 32' is pivoted intermediate its ends at 36 and 36' and its lower end is pivoted at 47, 47' to the drive shaft 24 by first and second eccentric assemblies 40, 40', as best seen in FIGS. 4 and 6. The eccentric assemblies are similar and, therefore, only the first eccentric assembly 40 will be described here.

The first eccentric assembly 40, as best seen in FIG. 6, includes a fixed eccentric 42 which is integral with the drive shaft 24 and an adjustable eccentric 44 which surrounds the first eccentric and is free to rotate thereabout. The first eccentric assembly is connected to the lower end of the lever 32 by a crank arm 46 which extends from a crank collar 48 which surrounds the adjustable eccentric 44, as best seen in FIG. 2. The crank arm 46 is pivotally attached to the lower end of the lever 32 by a pin 47. A roller bearing assembly 50 is provided between the eccentric 44 and the collar 48. The second eccentric assembly 40' is similar to the first eccentric assembly 40 except that the crank collar 48' is bifurcated to accommodate the crank collar 48 therebetween. The centers of the drive shaft, the fixed eccentric, and the adjustable eccentric are indicated at 52, 54, and 56 respectively, as shown in FIG. 6. When the adjustable eccentric 44 is rotated, the center 56 is also rotated about the center 54 of the fixed eccentric 42. In the position shown in FIG. 6, the fixed eccentric and the adjustable eccentric combine to provide a maximum off-center cranking movement to the crank collar 48 and crank arm 46 which in turn pivots the lever 32 about the pivot 36. As the adjustable eccentric 44 is rotated with respect to the fixed eccentric 42, the combined effect becomes less thereby reducing the off-center cranking movement. When the adjustable eccentric has rotated to a position 180 degrees from that shown in FIG. 6, its center 56 coincides with the center 52 of the drive shaft. In this position the effects of the two eccentrics cancel and the off-center cranking movement is reduced to zero resulting in no pivoting of the lever 32. It will be appreciated by those skilled in the art that during operation of the machine the adjustable eccentric 44 must be rigidly secured to the fixed eccentric 42, however, while adjusting the stroke the eccentric 44 must be free to rotate about the fixed eccentric 42. The securing mechanism for accomplishing this will now be described.

Figure 5:
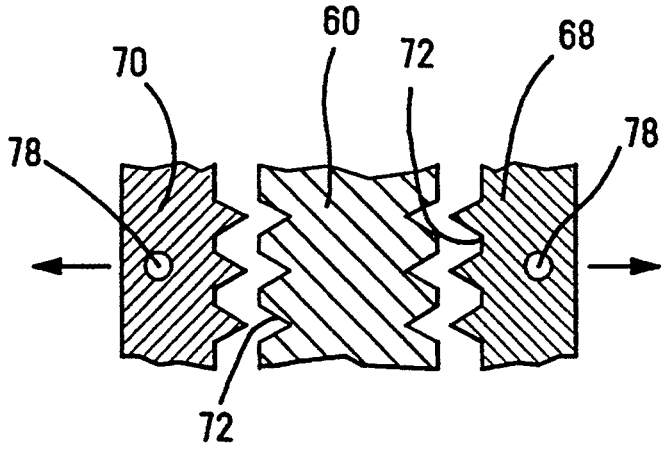
FIG. 5 is an enlarged cross-sectional view of the coupling mechanism indicated at A in FIG. 4.

There is shown in FIGS. 4, 5, and 6 a securing mechanism including a fixed coupling collar 60 that is rigidly attached to the fixed eccentric 42. The adjustable eccentric 44 is provided in two parts, **44*a* and 44*b*, one on each side of the collar 60. A pair of slidable sleeves 62 and 64 are arranged in counterbores 66 formed in the two parts of the adjustable eccentric. The sleeves 62 and 64 are a slip fit on the fixed eccentric 42 and will freely slide axially toward and away from the collar 60. The sleeves 62 and 64 each have flanges 68 and 70, respectively, that oppose the collar 60 as shown in FIGS. 4 and 6. The flanges 68 and 70 and the collar 60 each have radially extending intermatable teeth 72 on their opposing surfaces, as best seen in FIG. 5, that mate when the two sleeves 62, 64 slide into engagement with the collar 60. A plurality of axially extending members or coupling pins, 76, eight in the present example, are equally spaced in holes 77 formed in each of the two adjustable eccentric parts 44*a* and 44*b*, and are free to slide within the holes. One end of each coupling pin is attached to a respective flange 68, 70 by means of a pin 78 while the other end has a rounded nose 80 that is urged into engagement with a disk 82 by a spring 84. The disk 82, which is formed in two segments, is fitted into a circumferential groove 86 in the adjustable eccentric part 44*a* in a plane that is substantially normal to the rotational axis of the drive shaft 24, and is free to rotate therein. A similar disk 82 is arranged in a groove in the other eccentric part 44*b*** as shown.

Each disk 82 includes a series of recesses or pockets 90 and 92 positioned on either side of the points of engagements of the noses 80 of the coupling pins 76 with the disk 82. The pockets 90 are to the clockwise sides of the pins 78 while the pockets 92 are to the opposite sides thereof. The pockets 90 and 92 ramp up toward the points of engagement of their respective pins 76 so that when the disk 82 is rotated in either direction the noses 80 of the pins will be urged into their respective pockets by the springs 84. This causes the sleeves 62 and 64 to move away from the collar 60 thereby disengaging the teeth 72 so that the adjustable eccentric parts **44*a*, 44*b* are free to rotate. When the disk 82 is returned to its center position, shown in FIG. 6, the pins 76 cam up the ramps and out of the pockets thereby causing the teeth 72 of the sleeves 62, 64 and the collar 60 to again engage, thereby securing the adjustable eccentric 44 to the fixed eccentric 42. A ring gear 94 is attached to the periphery of each disk 82 by means of the screw fasteners 96. Mating spur gears 98 are attached to a shaft 100 that is journaled for rotation in a housing 102. The housing is movable by means of the linear actuators 104 to move the spur gears 98 into and out of engagement with the ring gears 94. The shaft 100 is connected to a hand crank, not shown, that is located on an outside wall of the module 12, 14, by means of the bevel gears 106 and other apparatus shown in the above mentioned U.S. patent application Ser. No. 07/968,012. Each part 44*a*, 44*b* of the adjustable eccentric 44 is coupled to its respective ring gear 94 through a lost motion connection consisting of a pair of arcuate slots 110 formed in the adjustable eccentric 44 and a pair of screws 112, one positioned in each slot, as shown in FIG. 6, and threaded into the disk 82. The slots 110 are arranged so that when the disk is rotated in either direction until the noses 80 of the pins 76 enter into the pockets 90, 92, the screws 112 will engage an end wall of the slots so that further rotation of the disk causes the adjustable eccentric to also rotate therewith. A drag device is provided which consists of a threaded hole 114 formed in the adjustable eccentric 44, a polyurethane pad 116 positioned in the hole, and a screw 118 threaded into the hole that forces the pad against the fixed eccentric 42, as best seen in FIG. 4**.

In operation the linear actuators 104 are fully retracted to their position shown in FIG. 3 with the spur gears 98 out of engagement with the ring gears 94. As the drive shaft rotates under power by the electric motor 26 the combined off-set of the fixed and adjustable eccentrics 42 and 44 cause the crank collar 48 and crank arm 46 to alternately push and pull against the pin 47 thereby pivoting the lever 32 back and forth to impart reciprocating motion to one of the ram assemblies. Opposing reciprocating motion is imparted to the other ram assembly in a similar manner by means of the fixed eccentric 42', which is 180 degrees out of phase with the fixed eccentric 42, the adjustable eccentric 44', the crank collar 48' and crank 46', and the lever 32'. This arrangement causes the two opposing ram assemblies to alternately reciprocate toward and away from each other to perform stamping and forming operations on the strip of stock.

When it is desired to shorten the length of stroke of the ram assemblies, the rotation of the drive shaft is stopped, the linear actuators activated to engage the spur gears 98 and ring gears 94. The hand crank, not shown, is then manipulated to cause the shaft 100 to rotate thereby causing the disks 82 to rotate in a first direction until the noses 80 of the pins 76 enter the pockets 90, thereby causing the teeth 72 of the sleeves 68 and 70 to disengage the teeth of the collar 60. During this movement the adjustable eccentric is prevented from rotating by the frictional force of the pads 116 against the surface of the fixed eccentric. As rotation of the disk 82 continues, in the same direction, the screws 112 engage the ends of the slots 110 thereby forcing the adjustable eccentric 44 to rotate therewith against the drag of the pads 116. Rotation of the disks 82 continues until the combined off-set of the two eccentrics produces the desired length of stroke. Such rotation is limited to the point where the center 56 of the adjustable eccentric exactly coincides with the center 52 of the drive shaft 24, at which point the length of the stroke will be zero. The hand crank is then turned in the opposite direction, thereby rotating the disk 82 in a second direction that is opposite to the first direction until the noses 80 of the pins 76 cam up the ramps of the pockets 90 causing the teeth 72 of the sleeves 68 and 70 to engage the teeth of the collar 60 thereby rotationally coupling the adjustable eccentric to the fixed eccentric. It should be noted that the amount of this rotation in the second direction exactly equals the amount of original rotation in the first direction. When it is desired to lengthen the stroke of the ram assemblies, the hand crank is turned to cause the disk 82 to rotate so that the noses 80 of the pins 76 enter into the pockets 92, at which point the adjustable eccentric may be rotated as desired, but not to exceed its position of maximum off-set, as shown in FIG. 6. In this manner the stroke lengths of the ram assemblies in both modules 12 and 14 may be adjusted to any desired value that is within the range of the machine 10, For example, on occasion it is desirable to set the length of stroke of one module to zero so that the torque that is available at both motors 26 can be allocated to the other module for its exclusive use.

Of the common operations performed on strip stock in a stamping and forming machine, of the type in the present example, blanking requires the higher tooling forces, forming usually requires a somewhat lower force, and coining may require a high force at only the bottom of the stroke. Coining operations have not been a problem in most cases because the crank eccentric inherently provides a mechanical advantage near the bottom of the stroke that is sufficient to perform the work. However, depending upon which mix of these operations are performed in each of the two modules 12 and 14, invariably one of the modules requires substantially more force than the other. It is this module that is selected and analyzed to determine the minimum length of stroke needed of the ram assemblies to perform the required operations. When calculating tonnage needed to blank a particular product profile it is customary to utilize CAD software. However, by way of example, a common formula in use sets the tonnage $T=C\times t\times S/2000$, where C equals the circumference in inches of the part to be blanked, t equals the thickness of the strip material, and S equals the shear stress of the material in pounds per square inch. The present stamping and forming machine modules have the capability to selectively accommodate discrete stroke lengths of 0.100, 0.200, 0.400, and 0.750 inches. Material thicknesses typically range from about 0.006 inch to about 0.032 inch with 0.016 inch most commonly used. In most cases, the shortest stroke length of 0.100 inch is suitable for blanking operations ill such strip material, however, there may be forming operations that are to be performed simultaneously in the same module. These forming operations may require a longer stroke. In any case, the shortest length stroke that will allow all of the required operations to be performed in the selected module is determined, and the adjustable eccentric for that module is adjusted to effect a stroke length that is slightly greater. This assures the shortest possible stroke and the greatest mechanical advantage in transferring power from the drive shaft to the tooling. This same procedure may also be used to set the stroke length of the ram assemblies in the other module as well. In the case where the other module is to not perform any operations, its stroke length may be set to zero thereby making power from the motors of both modules available to the selected module. Each module 12 and 14, in the present example, has the capability to deliver thirty tons of force to its tooling when the stroke length is set to 0.200 inch. When the stroke length of the ram assemblies of one of the modules is set to zero, the entire sixty tons of force is available to the selected module. Similarly, when the stroke length is shorter in one of the modules, that module has the potential to extract a proportionately greater amount of tonnage from the common drive shaft 24 than has the other module.

There are very important advantages in having the capability to selectively shorten the stroke length in a selected module while the stroke length in another module remains somewhat longer. Greater forces are available to the selected module, and the total combined tonnage of the machine can be distributed to the separate modules to meet their requirements thereby providing a more balanced dynamic system. In the case of a single module machine, the shorter stroke provides an additional mechanical advantage permitting higher forces with less energy consumption. Additionally, the shorter length of stroke results in a proportionately lower linear speed of the tooling. That is, the relative speed of the punch with respect to the die, for example, as it enters the die opening is less than would be the case if the stroke were longer. This yields substantially less wear of the punch and die assembly resulting in less down time and longer periods between sharpening. Typically, a stroke length of 0.400 inch can double the life of the tool over a tool having a stroke length of one inch. Reducing the stroke to 0.100 inch can increase tool life up to ten times. There is an exception to this, however. When the punch is very thin it tends to undergo fatigue during use. Relatively slow punch speeds may contribute to this fatigue so that higher punch speeds may be desirable in this case.

While in the present example the machine 10 has two modules 12 and 14, it will be understood by those skilled in the art that the present teachings may be advantageously applied to a machine 10 having any number of modules in excess of two.

I claim:

1. In a method of distributing power in a machine having at least two stamping and forming modules with their drive shafts rotationally coupled together, each said module including, a drive shaft, first and second ram assemblies which are reciprocable toward and away from each other between forward and retracted positions, first and second actuator levers for reciprocating the ram assemblies, each lever being coupled to its associated ram assembly and having a fixed pivot, the first and second levers being coupled to the drive shaft by first and second adjustable couplings which are adjustable for altering the length of stroke of the first and second ram assemblies, said method, including distributing power from said coupled drive shafts to said ram assemblies of said at least two stamping and forming modules, comprising the steps:

(a) determining the minimum length of stroke required to perform the stamping and forming operation in a selected module, (b) adjusting the adjustable couplings associated with said selected module to effect a stroke length of its ram assemblies at least as long as said determined minimum length, and (c) adjusting the adjustable couplings associated with another module to effect a stroke length of its ram assemblies that is different from that of said selected module.

2. The method according to claim 1 wherein prior to step (a), determining the force requirements for the stamping and forming operations being performed by each module, the module having the highest force requirement being said selected module.

3. The method according to claim 2 wherein each said adjustable coupling includes a rotatable eccentric, and said adjusting of step (b) includes rotating said eccentric a specific amount.

4. The method according to claim 3 wherein said rotatable eccentric includes securing means engagable for securing said eccentric in position relative to said drive shaft and disengagable for permitting said rotation of said eccentric relative to said drive shaft during said adjusting, and said rotating said eccentric of step (b) includes disengaging said securing means prior to said rotating and engaging said securing means after said rotating.

5. The method according to claim 4 wherein said securing means includes a disk arranged to rotate in a plane normal to the rotational axis of said drive shaft, and a member urged into engagement with said disk, said disk having a pocket, upon rotation of said disk said member enters said pocket thereby causing said securing means to disengage and upon rotation of said disk in another direction said member is forced out of said pocket thereby causing said securing means to engage, wherein said adjusting of step (b) includes the steps:

(b1) rotating said disk a first predetermined amount in one direction, causing said member to enter said pocket thereby causing said securing means to disengage said drive shaft, (b2) further rotating said disk a second predetermined amount in said one direction thereby rotating said eccentric with respect to said drive shaft, (b3) further rotating said disk said first predetermined amount in a second direction, causing said member to be forced out of said pocket thereby causing said securing means to engage said drive shaft.

6. The method according to claim 5 wherein during steps (b1) and (b3) including the step of biasing said eccentric and said drive shaft so that there is no relative rotation therebetween.

7. The method according to claim 6, prior to step (a), stopping rotation of said drive shaft.

8. The method according to claim 1 where in step (b), said different stroke length of the ram assemblies of said another module is adjusted to substantially equal zero.

* * * * *